US006511063B1

(12) United States Patent
Dickhoff et al.

(10) Patent No.: US 6,511,063 B1
(45) Date of Patent: Jan. 28, 2003

(54) APPARATUS FOR TRANSPORTING AND DELIVERING INDIVIDUAL SHEETS

(75) Inventors: Andreas Dickhoff, Kirchheim/Teck (DE); Helmut Domes, Stuttgart (DE); Andreas Schweizer, Bad Ditzenbach Gosbach (DE); Reinhard Weltz, Leonberg-Silberg (DE)

(73) Assignee: NexPress Solutions LLC, Rochester, NY (US)

( * ) Notice: Subject to any disclaimer, the term of this patent is extended or adjusted under 35 U.S.C. 154(b) by 30 days.

(21) Appl. No.: 09/688,892

(22) Filed: Oct. 16, 2000

(30) Foreign Application Priority Data

Oct. 15, 1999 (DE) ..... 199 49 708

(51) Int. Cl.[7] ..... B65H 29/00
(52) U.S. Cl. ..... 271/184
(58) Field of Search ..... 221/184, 306, 221/236, 225, 267; 270/58.15, 58.16, 58.17, 58.18, 58.19, 58.27, 58.28; B65H 9/10

(56) References Cited

U.S. PATENT DOCUMENTS 4,376,529 A * 3/1983 George et al. ..... 270/58.16
4,509,732 A * 4/1985 Kanno et al. ..... 198/457.03
6,102,391 A * 8/2000 Malick et al. ..... 271/184

FOREIGN PATENT DOCUMENTS

EP 0 490 216 A1 * 2/1991 ..... B65H/9/10

* cited by examiner

*Primary Examiner*—Donald P. Walsh
*Assistant Examiner*—Kenneth W Bower
(74) *Attorney, Agent, or Firm*—Lawrence P. Kessler

(57) ABSTRACT

An apparatus for transporting and delivering individual sheets (14) within a final processing unit (11) downstream from a printing or copying unit (10). In the final processing unit (11) an input transport roller pair (15) is followed by a sheet transport track (18) having a stop surface (20) for lateral registration of the sheets (14) passing through, a working delivery surface (24) having a stop surface (22) for end-surface registration of the sheets (14) being arranged at the end of the sheet transport track (18). Arranged after the working delivery surface (24) is a final delivery container for the individual sheets or sheet stacks, which extends at a 90° angle to the sheet transport track (18).

7 Claims, 2 Drawing Sheets

APPARATUS FOR TRANSPORTING AND DELIVERING INDIVIDUAL SHEETS

FIELD OF THE INVENTION

The invention is directed to an apparatus for transporting and delivering individual sheets within a final processing unit downstream from a printing or copying unit.

BACKGROUND OF THE INVENTION

European Patent Application 0 490 216 has disclosed an electrophotographic printing or copying unit into whose paper transport conduit. Individual sheets can be conveyed laterally at a 90° angle. The delivery regions have openings with associated orientation paddles. Following delivery of the individual sheets into the delivery regions, they are grasped by paper transport rollers and conveyed to the paper transport conduit. It Is possible with this apparatus to convey individual sheets in temporally serial fashion to a copying unit that is designed for parallel processing of individual sheets in a paper transport conduit.

SUMMARY OF THE INVENTION

It is the object of the invention to provide an apparatus with which individual sheets output from a printing or copying unit can, in a final processing unit, reliably be positionally oriented, transported, stacked with aligned edges, stapled if necessary, and delivered in job-sorted fashion into deliver containers. It is intended in this context for the sheet transport path to be as short as possible, and the space requirement for the apparatus to be as small as possible.

It is intended in this context for the sheet transport path to be as short as possible, and the space requirement for the apparatus to be as small as possible.

According to the present invention, this is achieved by the fact that in the final processing unit, an input roller pair is followed by a sheet transport track having a stop surface for lateral registration of the sheets passing through; that a working delivery surface having a stop surface for end-surface registration of the sheets is arranged at the end of the sheet transport track; and that a final delivery container, arranged after the working delivery surface, for the individual sheets of sheet stacks extends at a 90° angle to the sheet transport track. Advantageously, the sheet transport track is arranged between the input roller pair and the working delivery surface, and slopes downward toward the final deliver container. With the apparatus according to the present invention, the individual sheets can be conveyed quickly and in positionally oriented fashion to a final processing station, and there can be stacked with aligned edges. delivery surface having a stop surface for end-surface registration of the sheets is arranged at the end of the sheet transport track; and that a final delivery container, arranged after the working delivery surface, for the individual sheets or sheet stacks extends at a 90° angle to the sheet transport track.

Advantageously, the sheet transport track is arranged between the input roller pair and the working delivery surface, and slopes downward toward the final delivery container.

With the apparatus: according to the present invention, the individual sheets can be conveyed quickly and in positionally oriented fashion to a final processing station, and there can be stacked with aligned edges.

Specifically, the subject matter of the invention is configured so that the support surface of the sheet transport track is of undulating configuration in the transport direction; and that at least one registration means is provided. As a result of this configuration, the individual sheet is deflected in its transport direction and is stabilized in the direction toward the stop surface of the lateral registration system. Positionally oriented transport of the individual sheet is thereby substantially improved.

As a result of this feature, the individual sheet is deflected in its transport direction and is stabilized in the direction toward the stop surface of the lateral registration system. Positionally oriented transport of the individual sheet is thereby substantially improved.

Also greatly advantageous in terms of saving space is the fact that the working delivery surface is substantially narrower in the direction transverse to the sheet transport direction that the width of the incoming sheets or of the sheet stacks; and that a registration system is provided in the region of the working delivery surface. In this simple manner, only the portion of the sheets or of the sheet stack necessary for stapling is present on the working delivery surface, while the remaining portion already projects into the final delivery container. As a result, the displacement path of the sheets or of the stack until ultimate delivery in the final delivery container is substantially shortened.

In this simple manner, only the portion of the sheets or of the sheet stack necessary for stapling is present on the working delivery surface, while the remaining portion already projects into the final delivery container. As a result, the displacement path of the sheets or of the sheet stack until ultimate delivery in the final delivery container is substantially shortened.

The invention, and its objects and advantages, will become more apparent in the detailed description of the preferred embodiment presented below.

BRIEF DESCRIPTION OF THE DRAWINGS

The invention, and its objects and advantages, will become more apparent in the detailed description of the preferred embodiment presented below.

DETAILED DESCRIPTION OF THE INVENTION

Figure 1:
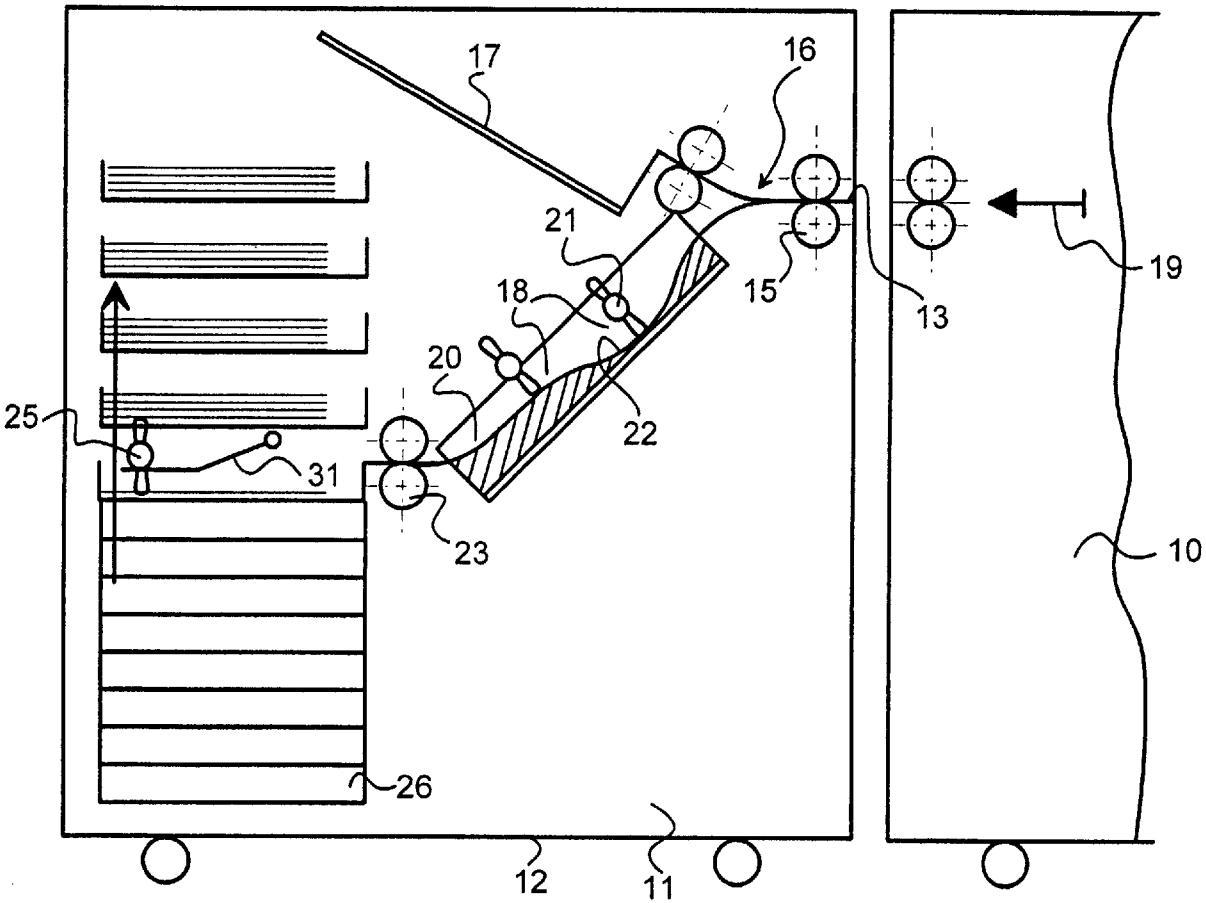
FIG. 1 shows the apparatus according to the present invention, in section, in a schematic depiction.

FIG. 1 depicts a printing or copying unit 10, downstream from which is a final processing unit, for example a finisher equipped with a stapling apparatus and sorting device. Final processing unit 11 includes a housing 12 having an inlet slot 13, facing toward printing or copying unit 10, for copies output from the latter in the form of individual sheets of paper 14. Located in the inlet slot in transport direction 19 of sheets 14 is a transport roller pair 15 which is followed by a diverter 16. Depending on the position of diverter 16, sheets that are not intended for further processing run into a separate delivery tray 17.

Sheets 14 that are to be further processed are conveyed to a sheet transport track 18, arranged after diverter 16. The sheet transport track is equipped with a stop surface 20 oriented in transport direction 19. While a sheet 14 is passing through sheet transport track 18, two (in the exemplary embodiment) registration device 21, configured as vane wheel loggers, ensure that each sheet 14 moves as it passes through with its long edge against stop surface 20, and is thus oriented correctly in position.

While a sheet 14 is passing through sheet transport track 18, two (in the exemplary embodiment) registration means 21, configured as vane wheel loggers, ensure that each sheet 14 moves as it passes through with its long edge against stop surface 20, and is thus oriented correctly in position.

In order to ensure reliable sheet transport even with thin sheets and a high throughput rate, support surface 22 of sheet transport track 18 is of undulating configuration in transport direction 19. One of registration devices 21 is arranged in the trough of the undulation in order to adapt a sheet 14 to the undulating shape as it passes through and thus to impart greater stability to the sheet. This results in precise edge guidance of sheet 14 against stop surface 20, and prevents any overrunning of stop surface 20 or creasing of sheet 14.

Figure 2:
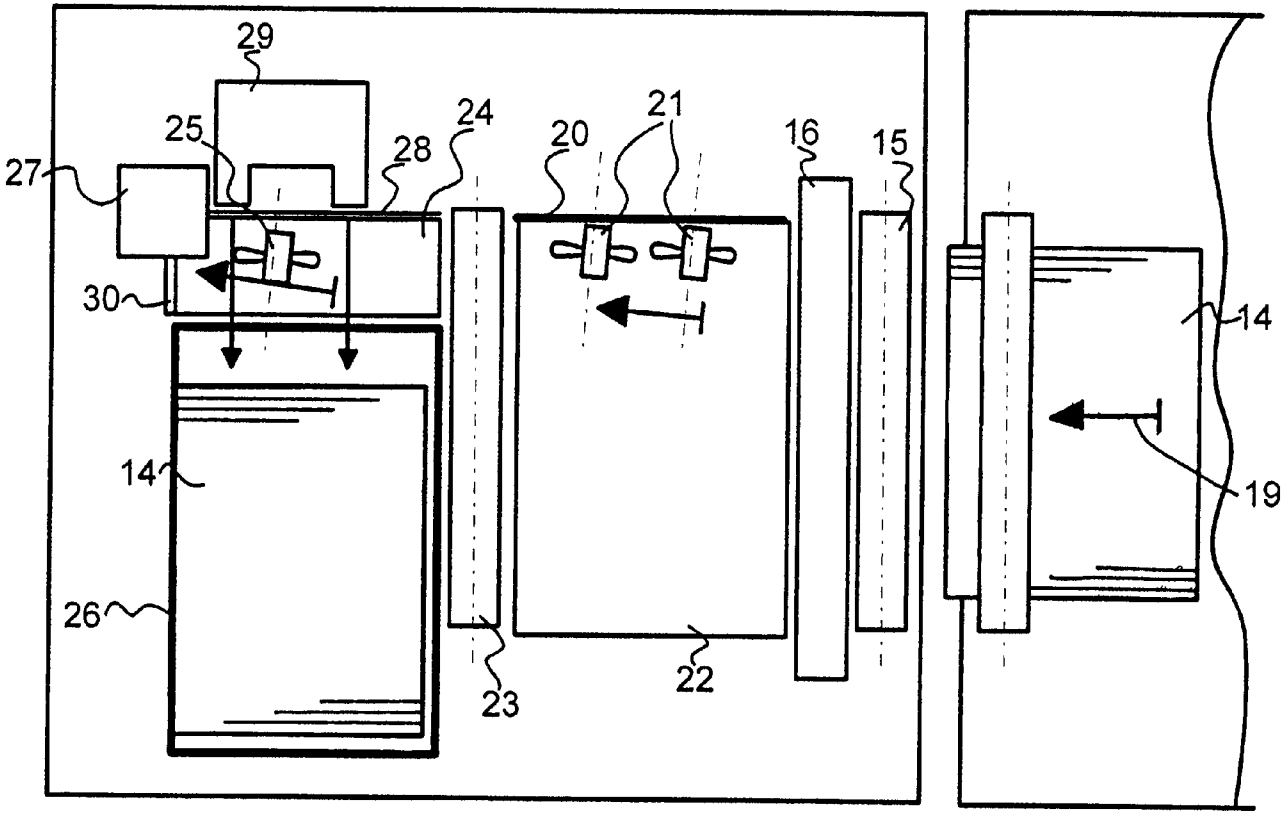
FIG. 2 shows the apparatus of FIG. 1 in a plan view.

Sheet 14 then passes through a further roller pair 23 and is delivered onto a working delivery surface 24 by a further registration device 25, configured for example as a vane wheel jogger. Registration device 25 transports and aligns the sheet 14 against a stop surface 30 provided at the end (see FIG. 2). This working delivery surface 24 has, however, a length measured transverse to transport direction 19, which is substantially less than the length or width of sheet 14 that has been delivered. The overhanging remainder of sheet 14, or of the growing sheet stack, already lies in a final delivery container 26 that directly adjoins working delivery surface 24 at the same height. In order to equalize the height of the growing stack with respect to registration device 25, the latter is mounted on a single-arm rocker 31. The purpose of this arrangement is to minimize firstly the space requirement of final processing unit 11, and secondly the length of the transport path for sheets 14.

The purpose of this arrangement is to minimize firstly the space requirement of final processing unit 11, and secondly the length of the transport path for sheets 14.

A stapling apparatus 27, with which a sheet stack having its edges aligned, can be stapled together, is arranged in the region of working delivery surface 24 at a suitable point. Individual sheets 14 are delivered with their edges aligned, while sheets 14 are being transported, because of the lateral alignment against stop surface 20 of sheet transport track 18, and because of the end-surface alignment against stop surface 30 of working delivery surface 24. In order to retain the alignment of sheets 14 that has already been accomplished a longitudinal stop 28 is additionally provided on working delivery surface 24.

Once the sheet stack has been formed from the incoming sheets 14, it is inserted by an ejector apparatus 29, stapled or unstapled, completely into the waiting final delivery container 26, which is already accommodating the greater part of the sheet stack. Longitudinal stop 28 has, for this purpose, openings (not depicted) for passage of the ejector apparatus. Final delivery containers 26 belong to a group of containers and either are movable vertically up and down or can be moved endlessly in a bucket lift apparatus. For this purpose, devices are known which keep the unoccupied containers tacked closely against one another and separate the containers at a distance from one another after they are loaded. This facilitates access to the sheet stacks in the containers. When the printer used is one to which different users can have access, the final processing unit can be used as a mailbox by assigning one of more delivery containers to a specific user.

Final delivery containers 26 belong to a group of containers and either are movable vertically up and down or can be moved endlessly in a bucket lift apparatus. For this purpose, devices are known which keep the unoccupied containers stacked closely against one another and separate the containers at a distance from one another after they are loaded. This facilitates access to the sheet stacks in the containers.

When the printer used is one to which different users can have access, the final processing unit cap be used as a mailbox by assigning one or more delivery containers to a specific user.

The invention has been described in detail with particular reference to certain preferred embodiment thereof, but it will be understood that variations and modifications can be effected within the spirit and scope of the invention.

PARTS LIST

10 Printing or copying unit
11 Final processing
12 Housing
13 Inlet slot
14 Sheets (of paper)
15 Transport roller pair
16 Diverter
17 Separate delivery tray
18 Sheet transport track
19 Transport direction
20 Stop surface
21 Registration device (vane wheel jogger)
22 Support surface
23 Roller pair
24 Working delivery surface
25 Registration device
26 Final delivery container
27 Stapling apparatus
28 Longitudinal stop
29 Ejector apparatus
30 Stop surface (working delivery surface)
31 Rocker

What is claimed is:

1. An apparatus for transporting and delivering individual sheets within a final processing unit downstream from a printing or copying unit, comprising: an input transport roller pair in said final processing unit is followed by a sheet transport track having a stop surface for lateral registration of sheets passing through; a working delivery surface having a stop surface for end-surface registration of the sheets is arranged at one end of said sheet transport track; and a final delivery container, arranged after said working delivery surface, for the individual sheets or sheet stacks extends at a 90° angle to said sheet transport track; wherein said sheet transport track being arranged between said input transport roller pair and said working delivery surface, and slopes downward toward a final delivery container.

2. The apparatus as defined in claim 1, wherein a support surface of said sheet transport track is of undulating configuration in the transport direction; and that at least one registration device is provided in the region of said support surface.

3. The apparatus as defined in claim 1, wherein said final delivery container is an element of a group of containers comprising multiple containers, whose individual containers are guided in vertically movable fashion and can be positioned successively in the plane of said working delivery surface.

4. The apparatus as defined in claim 1, wherein said working delivery surface is substantially narrower in the direction transverse to the sheet transport direction than the width or length of incoming sheets or of the sheet stacks; and that a registration device (25) is provided in the region of said working delivery surface.

5. The apparatus as defined in claim 4, wherein registration device in the region of said support surface is configured as a vane wheel jogger and is arranged on a single-arm rocker in the region of said stop surface for end-surface registration of sheets.

6. The apparatus as defined in claim 4, wherein a stapling apparatus for the sheets collected and oriented on said working delivery surface is arranged in the region of said working delivery surface.

7. The apparatus as defined in claim 6, wherein an ejector apparatus for the collected and oriented sheets or sheet stacks is arranged, movably back and forth transverse to the sheet transport direction, in the plane of said working delivery surface.

* * * * *